US008330376B2

(12) United States Patent
Hunt et al.

(10) Patent No.: US 8,330,376 B2
(45) Date of Patent: Dec. 11, 2012

(54) SYSTEM AND APPARATUS FOR CATHODOLUMINESCENT LIGHTING

(75) Inventors: Charles E. Hunt, Davis, CA (US); Regan Andrew Zane, Superior, CO (US); Richard N. Herring, Longmont, CO (US)

(73) Assignee: Vu1 Corporation, Seattle, WA (US)

( * ) Notice: Subject to any disclaimer, the term of this patent is extended or adjusted under 35 U.S.C. 154(b) by 0 days.

(21) Appl. No.: 13/350,744

(22) Filed: Jan. 14, 2012

(65) Prior Publication Data

US 2012/0126701 A1 May 24, 2012

Related U.S. Application Data

(60) Continuation of application No. 12/946,154, filed on Nov. 15, 2010, now Pat. No. 8,102,122, which is a division of application No. 11/969,840, filed on Jan. 4, 2008, now Pat. No. 7,834,553.

(60) Provisional application No. 60/888,187, filed on Feb. 5, 2007.

(51) Int. Cl.
*H05B 39/00* (2006.01)

(52) U.S. Cl. ..... 315/101; 315/105; 315/247

(58) Field of Classification Search ..... 315/1, 3, 315/51, 57, 94, 101, 105, 106, 107, 112, 315/115, 116, 200 R, 206, 246, 247, 276, 315/279, 283, 291, 307
See application file for complete search history.

(56) References Cited

U.S. PATENT DOCUMENTS 6,504,311 B1 * 1/2003 Kumar et al. ..... 315/169.3

* cited by examiner

*Primary Examiner* — Thuy Vinh Tran
(74) *Attorney, Agent, or Firm* — Lathrop & Gage LLP

(57) ABSTRACT

A cathodoluminescent lighting system has a light emitting device having an envelope with a transparent face, a cathode for emitting electrons, an anode with a phosphor layer and a conductor layer. The phosphor layer emits light through the transparent face of the envelope. The system also has a power supply for providing at least five thousand volts of power to the light emitting device, and the electrons transiting from cathode to anode are essentially unfocused. Additional embodiments responsive to triac-type dimmers with intensity and color-changes in response to dimmer control. A power-factor-corrected embodiment is also disclosed.

12 Claims, 7 Drawing Sheets

SYSTEM AND APPARATUS FOR CATHODOLUMINESCENT LIGHTING

RELATED APPLICATIONS

This application is a continuation of U.S. patent application Ser. No. 12/946,154, filed Nov. 15, 2010, now issued as U.S. Pat. No. 8,102,122 B2, which is a divisional of U.S. application Ser. No. 11/969,840 filed Jan. 4, 2008, now issued as U.S. Pat. No. 7,834,553, which claims priority to U.S. Provisional Patent Application Ser. No. 60/888,187, filed Feb. 5, 2007. U.S. application Ser. No. 11/969,840 is related to the material of U.S. patent application Ser. No. 11/969,831, filed Jan. 4, 2008, now issued as U.S. Pat. No. 8,058,789, entitled Cathodoluminescent Phosphor Lamp. Each of the aforementioned applications is incorporated herein by reference.

FIELD OF THE INVENTION

The present document describes a lighting device embodying a defocused cathode-ray device and driving circuitry. Embodiments have enhanced power factor and are compatible with conventional triac and other dimmers.

BACKGROUND OF THE INVENTION

Typically, lamps used for general lighting utilize a tungsten filament that is heated to generate light. This process, however, is generally inefficient because a significant amount of energy is lost to the environment in the form of extraneous heat and non-visible, infrared and ultraviolet, radiation. Other alternatives for general lighting include fluorescent lamps and light emitting diodes. While more efficient than incandescent lamps having tungsten filaments, fluorescent lamps tend not to have pleasing spectral characteristics, and light emitting diodes tend to be expensive.

It has been known for at least a century that electrons accelerated by high voltage in vacuum, otherwise known as cathode rays, can cause compounds known as phosphors to emit light when they strike those compounds. Much cathode ray tube (CRT) effort over the last century has been aimed towards apparatus using tightly focused, deflectable, electron beams for use in television, radar, sonar, computer, oscilloscope, and other information displays; these devices are hereinafter referenced as data display CRTs. CRTs have not generally been used for general lighting.

Data display CRTs typically operate with deflection circuitry for steering their electron beams and have such tightly focused electron beams that operation without deflection may "burn" their phosphor coating causing permanent damage. Such CRTs often, but not always, are operated by high voltage power supplies linked to their deflection circuitry.

Voltage multipliers driven by inverters have been used to provide the high voltage required to accelerate electrons in data display CRTs. For example, U.S. Pat. No. 5,331,255 describes a DC-to-DC converter having an inverter operating at about 1 MHz driving a Cockroft-Walton voltage multiplier to produce high voltage for driving a small data display CRT.

Many homes, businesses, and appliances have been wired with triac-type and similar dimmers. These dimmers block a user-adjustable portion of an alternating current waveform. Triac dimmers typically work well with incandescent lighting and other resistive loads, reducing light intensity or heat output by reducing an on-phase of each AC cycle, but typically do not work well with electronic loads such as compact fluorescent lamps.

Electronic loads such as many compact fluorescent lamps also tend to draw current as spikes almost exclusively at voltage peaks of the incoming AC waveform. These current spikes cause these loads to have a poor "power factor", and can cause inefficiencies in a power system.

SUMMARY OF THE INVENTION

A cathodoluminescent lighting system has a light emitting device having an envelope with a transparent face, a cathode for emitting electrons, an anode with a phosphor layer and a conductor layer. The phosphor layer emits light through the transparent face of the envelope. The system also has a power supply for providing at least two thousand volts between anode and cathode of the light emitting device, and the electrons transiting from cathode to anode are essentially unfocused.

DETAILED DESCRIPTION OF THE EMBODIMENTS

Figure 1:
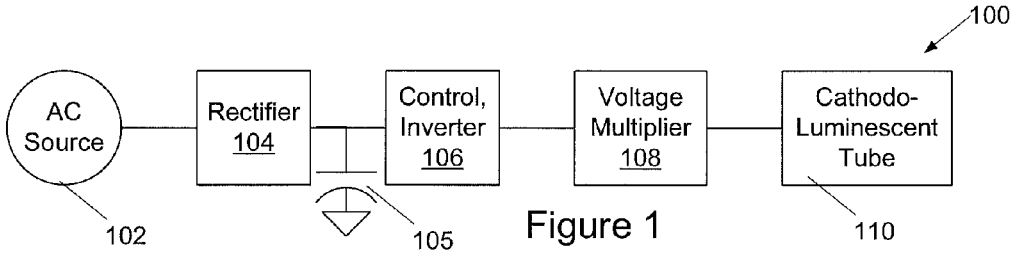
FIG. 1 is a block diagram of a lighting system embodying a cathodoluminescent lighting device.

An embodiment of a cathodoluminescent lighting system 100 (FIG. 1) is powered by an external AC power source 102. AC power from the power source 102 is rectified by a bridge rectifier 104 into DC and filtered by a capacitor 105. In embodiments operating from a 120-volt AC power source 102, this resulting DC voltage is approximately 160 volts. Filtering components may also be present in the bridge rectifier 104 block to prevent undesirable emissions from being coupled back into the power source 102 and to protect cathodoluminescent lighting system 100 from spikes and surges on AC power source 102. The resulting DC powers a controller-inverter unit 106, to provide high frequency AC that in turn feeds a voltage-multiplying rectifier 108 to provide high voltage suitable for powering a cathodoluminescent tube 110.

Figure 1A:
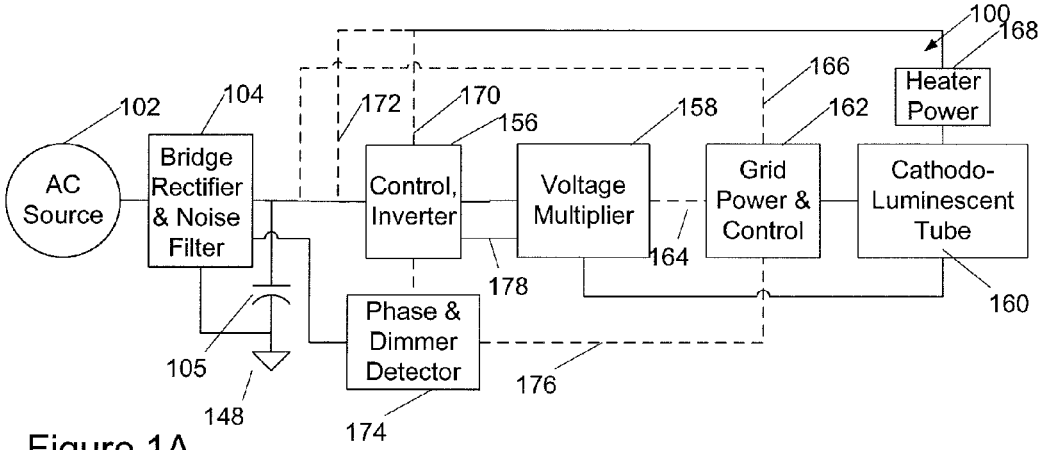
FIG. 1A is a block diagram of a lighting system embodying a cathodoluminescent lighting device with power factor correction and dimmer controllability.

FIG. 1A illustrates in slightly more detail an embodiment of a lighting system 100 embodying a cathodoluminescent lighting device with power factor correction and dimmer controllability. This embodiment is powered by external AC power source 102, hereinafter mains AC. AC power from the power source 102 is rectified by a bridge rectifier 104 into DC with an internal ground 148 and filtered by capacitor 105. In embodiments operating from a 120-volt AC power source 102, this resulting DC voltage is approximately 160 volts, while in embodiments operating from a 240-volt AC power source this DC voltage is approximately 320 volts. Filtering components may also be present in the bridge rectifier 104 block to prevent undesirable emissions, such as radio frequency noise from a controller-inverter unit 156 from being coupled back into the power source 102.

The DC from rectifier 104 and capacitor 105 powers controller-inverter unit 156, to provide high frequency AC that in turn feeds a voltage-multiplying rectifier 158 to provide high voltage suitable for anode to cathode power of cathodoluminescent tube 160.

Cathodoluminescent tube 160 also requires an extraction grid bias voltage, supplied by a grid power and control unit 162. In embodiments where the cathode of cathodoluminescent tube 160 is greatly negative with respect to the internal ground 148, grid power and control unit 162 is powered by a tap 164 from voltage-multiplying rectifier 158, while in embodiments where the cathode of cathodoluminescent tube 160 is at or near internal ground 148, grid power and control unit 162 is powered by a tap 166 from capacitor 105 and rectifier 104.

In embodiments having a thermionic cathode in cathodoluminescent tube 160, cathodoluminescent tube 160 also requires heater power from a heater power supply 168. In some embodiments, including many embodiments where the cathode of cathodoluminescent tube 160 is far below internal ground 148, heater power supply 168 is inductively coupled 170 to draw power from controller-inverter unit 156. In other embodiments, heater power supply 168 is coupled 172 to draw power from capacitor 105, or coupled 173 to draw power from a node or inductor in the voltage multiplier 158.

In embodiments having power factor correction and/or dimmer controllability, a phase and dimmer detector 174 may be coupled through rectifier 104 to monitor incoming power. In embodiments having power factor correction, controller-inverter unit 156 responds to a phase detected by phase and dimmer detector 174. In many embodiments having dimmer controllability, grid power and control unit 162 responds to a detected dimmer setting signal 176 from phase and dimmer detector 174 to adjust or pulse grid voltages supplied to cathodoluminescent tube 160; alternatively in some embodiments controller-inverter unit 156 responds to detected dimmer settings by altering the AC voltage it provides to voltage multiplier 158, thereby altering anode to cathode voltages provided to cathodoluminescent tube 160.

In many embodiments, the AC voltage provided by controller-inverter unit 156 to voltage multiplier 158, or a DC voltage tapped from an early stage of voltage multiplier 158, is fed back 178 to the controller-inverter unit 156 to provide a degree of voltage regulation, thereby stabilizing anode to cathode voltages provided to the cathodoluminescent tube 160.

Figure 3:
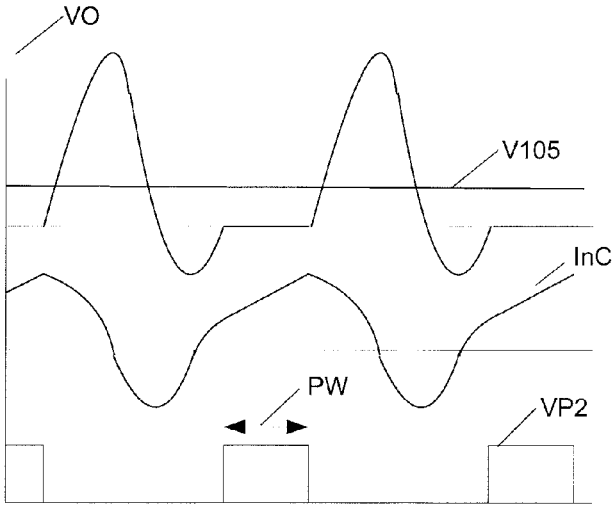
FIG. 3 is an approximate waveform of the inverter of FIG. 2 in resonant mode.
Figure 2:
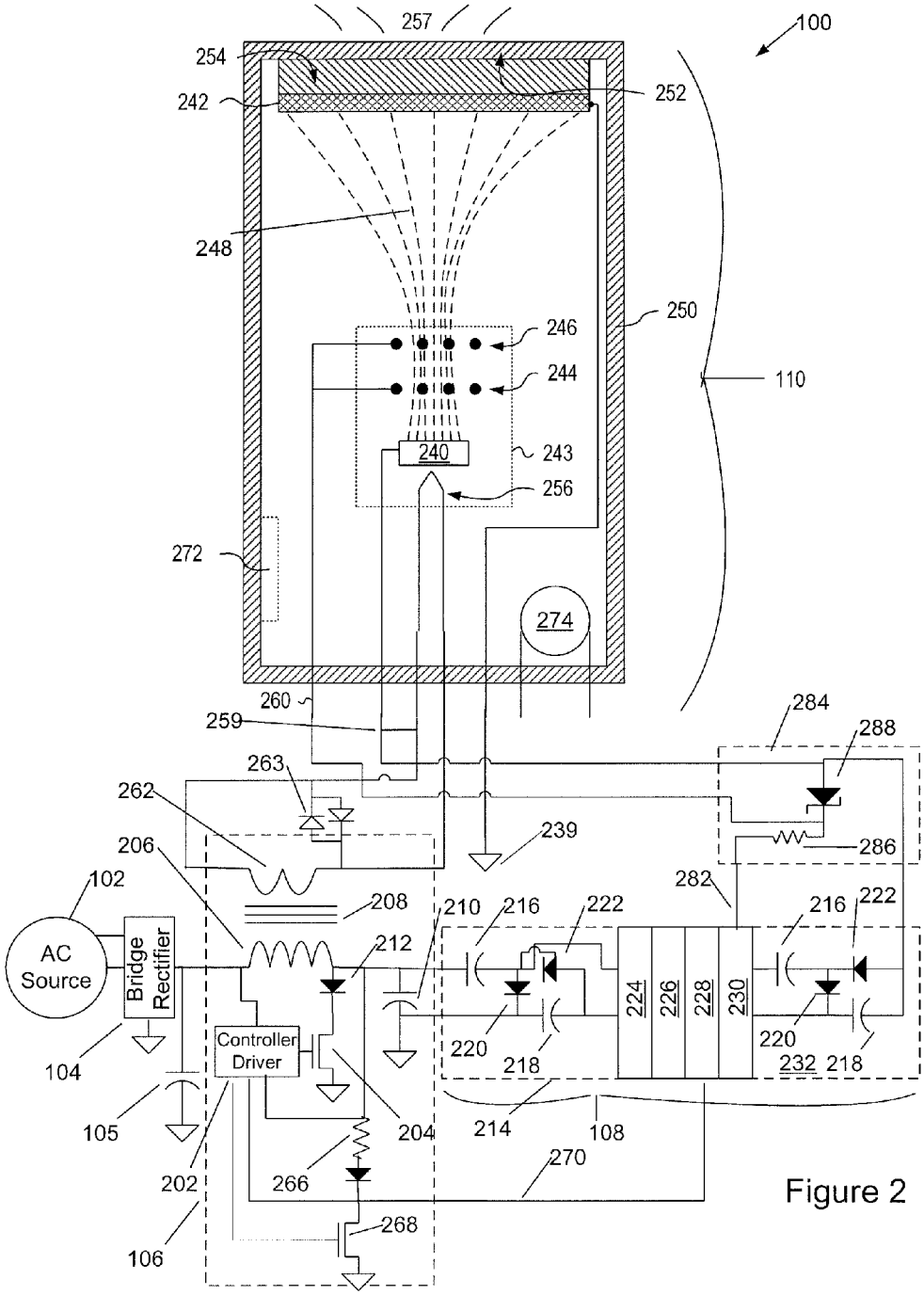
FIG. 2 is an approximate schematic diagram of a lighting system embodying a cathodoluminescent lighting device with thermionic cathode and inverter having an inductor with grounded anode.

A particular embodiment of the cathodoluminescent lighting system 100 of FIG. 1 or FIG. 1A is illustrated FIG. 2. In this embodiment, controller-inverter unit 106 includes a controller-driver 202 that controls a switching transistor 204. Switching transistor 204 is preferably an NMOS transistor, but may be any other suitable switching device such as an NPN or IGBT transistor as known in the art. As illustrated in FIG. 3, when transistor 204 (FIG. 2) turns on, AC voltage VO at output of the controller-inverter unit 106 and the input of the voltage multiplying rectifier 108 goes to near zero and current builds up in an inductor 206, which may be wound on a ferrite core 208; application of current to the inductor 206 through transistor 204 is known as kicking the inductor. When current reaches a maximum value determined by controller-driver 202, as determined by an effective pulsewidth PW of on-time of transistor 204, transistor 204 is turned off. The inductor 206 continues carrying current InC momentarily, causing voltage at the input of the voltage multiplying rectifier 108 to kick up well above the DC voltage V105 at capacitor 105. This voltage at the input of multiplying rectifier 108 appears across a capacitance that represents an input capacitance of voltage multiplying rectifier 108 in parallel with a small noise-suppression capacitor 210.

Since voltage at the input of multiplying rectifier 108 will exceed the DC voltage at capacitor 105, current InC in the inductor 206 will reverse, eventually driving voltage V0 at the input of voltage multiplying rectifier 108 below the DC voltage at capacitor 105 and possibly below ground. Current in parasitic junctions of transistor 204 when voltage at the input of multiplying rectifier 108 is below ground is suppressed by a diode 212. Inductor 206 effectively forms a series-resonant circuit with the input capacitance of the multiplying rectifier 108 and noise suppression capacitor 210, and voltage at the input of multiplying rectifier 108 will resemble a portion of a damped sine wave AC waveform.

At an appropriate time in the next or a subsequent cycle of the AC waveform, preferably synchronized at an appropriate point of the waveform of voltage at the input of voltage multiplying rectifier 108 so that maximum energy is recovered from multiplying rectifier 108 and input capacitance 210, controller-driver 202 turns on VP2 switching transistor 204 again to give the inductor another kick, thereby sustaining AC at the input of the multiplying rectifier 108.

An inverter as herein described with reference to inductor 206, transistor 204, and controller-driver 202, is hereinafter a resonant-flyback inverter.

Peak current in the inductor 206, power drawn from capacitor 105, and therefore peak voltage at the input of multiplying rectifier 108 and output voltage of the multiplying rectifier are all strongly dependent upon the pulserate and pulsewidth PW of transistor 204. Operation with sparse pulses or narrow pulsewidths will reduce output voltage by reducing current in inductor 206 and resultant peak voltage at the input of voltage multiplying rectifier 108, while operation with frequent and wide pulsewidths will tend to increase output voltages.

Alternative embodiments may have other inverter designs than illustrated in FIG. 2. For example, a transformer-coupled inverter may be used, in which a secondary winding coupled to inductor 206 drives the voltage multiplying rectifier 108. In yet another embodiment, a traditional class-E stage is used to provide the AC power supplied to voltage multiplying rectifier 108.

Voltage multiplying rectifier 108 is a multistage multiplier resembling the Cockroft-Walton type. A basic stage 214 of this unit has a coupling capacitor 216, a filter capacitor 218, and two high voltage diodes 220, 222. DC output of the stage is taken at the output side of the filter capacitor 218, and DC-offset AC output is taken at the coupling capacitor 216; these outputs then feed into following stages 224, 226, 228, 230, 232. The number of stages in the multistage voltage multiplying rectifier 108 varies with the designed AC source 102 line voltage as well as desired operating conditions, including an anode 242-a cathode 240 operating voltage, of the cathodoluminescent tube 110 and characteristics of the controller-inverter unit 106.

Ground and an output of the final stage 232 of the voltage multiplying rectifier 108 are coupled to provide a high voltage between anode 242 of tube 110 and cathode 240 of cathodoluminescent tube 110, such that anode 242 is positive by a voltage between two kilovolts and thirty kilovolts with respect to cathode 240. In FIG. 2, cathode 240 is driven between two kilovolts and thirty kilovolts negative with respect to internal ground 239, however in alternative embodiments cathode 240 is at internal ground 239 with anode 242 being driven between two kilovolts and thirty kilovolts positive with respect to ground 239—the difference in voltage between anode 242 and cathode 240 is much more significant to tube operation than are voltages with respect to internal ground 239.

Embodiments having cathode 240 below internal ground, with anode 242 at internal ground, are preferred because in the event of an envelope 250 fracture, cathode 240 is expected to be less likely to contact a living creature or human than is the relatively large anode 242.

Cathode 240 forms part of an electron gun 243, along with an extraction grid 244 and a defocusing grid 246 for emitting a broad, unfocused, beam 248 of electrons such that the voltage difference between anode 242 and cathode 240 will accelerate the electrons towards anode 242. Anode 242 is preferably a thin, light-reflective, layer of a metal such as aluminum. Electron gun 243 and anode 242 are contained within evacuated envelope 250, fabricated of a nonporous material such as glass and having a transparent faceplate 252. Layered between anode 242 and faceplate 252 is at least one layer 254 of a phosphor material as known in the art of cathode-ray tube displays and chosen for desired spectral characteristics of light 257 to be emitted through faceplate 252 by operation of cathodoluminescent lighting system 100. A thin "lacquer" layer may exist between phosphor layer 254 and anode layer 242 to prevent diffusion of anode layer 242 into phosphor layer 254. Anode layer 242 is preferably thin enough to permit most electrons striking it to either pass through it into phosphor layer 254 or to scatter additional electrons from anode 252 into phosphor layer 254.

In the embodiment of FIG. 2, the cathode 242 is a hot, thermionic, cathode requiring a tungsten-filament heater 256 inside the cathodoluminescent tube 110 for optimum electron emission. In embodiments having a hot cathode 240, the heater 256 may require from half a watt to two watts of power. In an alternative embodiment, cathode 240 is a cold cathode not requiring a heater 256. The heater 256 may in some embodiments be electrically connected 259 to the cathode 240; in some embodiments a direct-heated cathode is used.

In embodiments having a hot or thermionic cathode 240 as illustrated, the power supply includes a heater power supply for powering the heater 256. In the illustrated embodiment of FIG. 2, a winding 262, magnetically coupled through core 208 to inductor 206, is provided to provide power to heater 256. In this embodiment, clamp diodes 263 limit peak voltage across the heater to approximately eight-tenths of a volt to prevent cathode overheating; in alternative embodiments clamp diodes 263 may be Schottky diodes to limit peak voltage across the heater to a value of less than eight-tenths of a volt. In alternative embodiments, back to back Zener diodes may be provided to limit voltage to a level higher than eight tenths of a volt, or an integrated circuit voltage or current regulator may be provided for heater supply control. In embodiments having back-to-back Zener diodes, these diodes may have different breakdown voltages to limit voltage asymmetrically, which may provide a better match to an inverter of the type illustrated in FIG. 2, similarly embodiments having clamp diodes 263 as shown in FIG. 2 may combine a silicon with a Schottky diode to provide asymmetric clamping. In an embodiment, heater current is provided to heater 256 by an integrated regulator at a first level when the system 100 is first turned on, this current being reduced to a second level for continuing operation once the heater 256 reaches an appropriate operating temperature. In an alternative embodiment, a dump resistor 266 is provided with a suitable switch transistor 268, this switch transistor 268 is turned ON at appropriate times during a heater 256 warm-up time when system 100 is first turned on to allow resistor 266 to absorb energy from controller-inverter unit 106 to keep current in inductor 206 high enough such that power is supplied to heater 256 through winding 262.

Figure 2A:
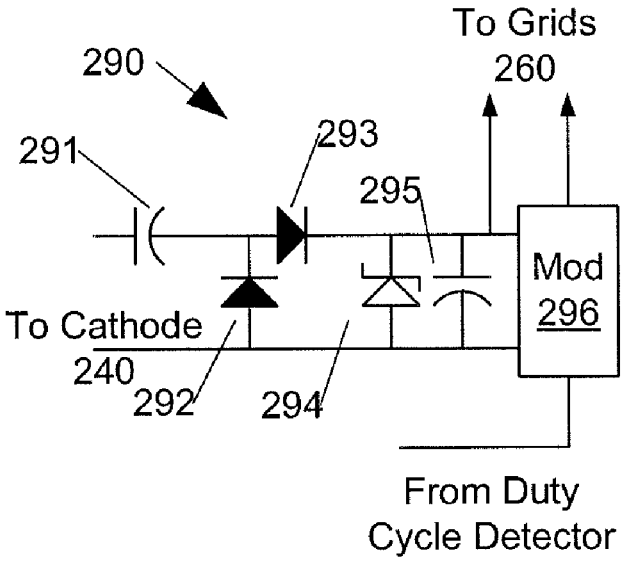
FIG. 2A is a diagram of an alternate embodiment of the grid power & control such as may be used with the embodiment of FIG. 2.

In the embodiment of FIG. 2, a voltage 282 between approximately one hundred and three hundred volts positive with respect to cathode 240 is tapped from the power supply formed by bridge rectifier 104, controller-inverter unit 106, and voltage multiplying rectifier 108; this voltage 282 is applied to the grid power and control 284 to provide a voltage 260 to extraction grid 244 and defocusing grid 246 of electron gun 243 of tube 110. In an embodiment, this supply incorporates a resistor 286 and Zener diode 288 to provide voltage 260 of approximately seventy-five volts positive with respect to the cathode 240; in alternative embodiments Zener diodes of other voltages may be used. In alternative embodiments, as illustrated in FIG. 2A, in an alternate embodiment 290 of the grid power and control 284, a small capacitor 291 taps an AC node in the voltage multiplying rectifier 108 to power a charge pump comprising diodes 292, 293, small filter capacitor 295 and Zener diode 294; the charge pump coupled to cathode 240. In some embodiments, extraction grid 244 and defocusing grid 246 are coupled directly to the filter capacitor 295, in other embodiments including some embodiments with dimmer controllability they are coupled through grid control and modulator 296. Grid control and modulator 296 responds to information relayed to it from the phase & dimmer detector 174 (FIG. 1A) of embodiments having dimmer control. This information may be transmitted to grid control and modulator 296 from phase & dimmer detector 174 through FM modulation of controller-inverter unit 156, through AC signals passed inductively or through a low value blocking capacitor, or through an optical isolator (not shown).

Figure 2B:
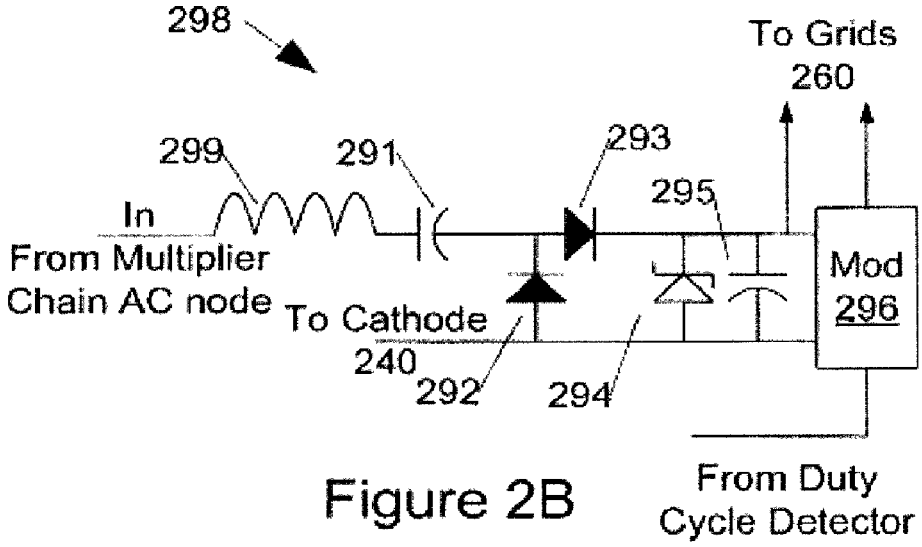
FIG. 2B is a diagram of an alternate embodiment of the grid power & control such as may be used with the embodiment of FIG. 2.

In yet another embodiments, as illustrated in FIG. 2B, in an alternate embodiment 298 of the grid power and control 284, a small inductor 298 is in series with capacitor 291 to tap an AC node in the voltage multiplying rectifier 108 to power a charge pump comprising diodes 292, 293, small filter capacitor 295 and Zener diode regulators 294. The extraction grid voltage may be derived from a modulator 296 or additional Zener diode. The charge pump is also coupled to the cathode 240 end of the voltage multiplier.

The power supply, including voltage-multiplying rectifier 108, grid power and control 284, and controller-inverter unit 106 is assembled using integrated circuit and surface-mount technologies as known in the art, and potted with a suitable high-voltage potting compound to prevent arcing.

In some embodiments, a voltage from a filter capacitor of the voltage-multiplying rectifier 108, which may be, but preferably is not, the highest output voltage of the voltage-multiplying rectifier 108, is tapped and fed back 270 through a resistive divider to controller-driver 202 of inverter 106 such that the accelerating potential difference between anode 242 and cathode 240 is maintained at a desirable level. In an alternative embodiment, feedback control of controller-inverter unit 106 through adjustment of pulse rate and pulse-width at transistor 204 is sufficient to permit operation of the cathodoluminescent lighting system 100 on AC source voltages ranging from 110 to 250 volts and 50 to 60 hertz so as to operate on 120-volt AC as common in the United States, or on 240-volt AC as is common in many European countries.

The cathodoluminescent tube 110 may contain passive getter materials 272 or an active getter 274 as known in the art of vacuum tubes.

Figure 4:
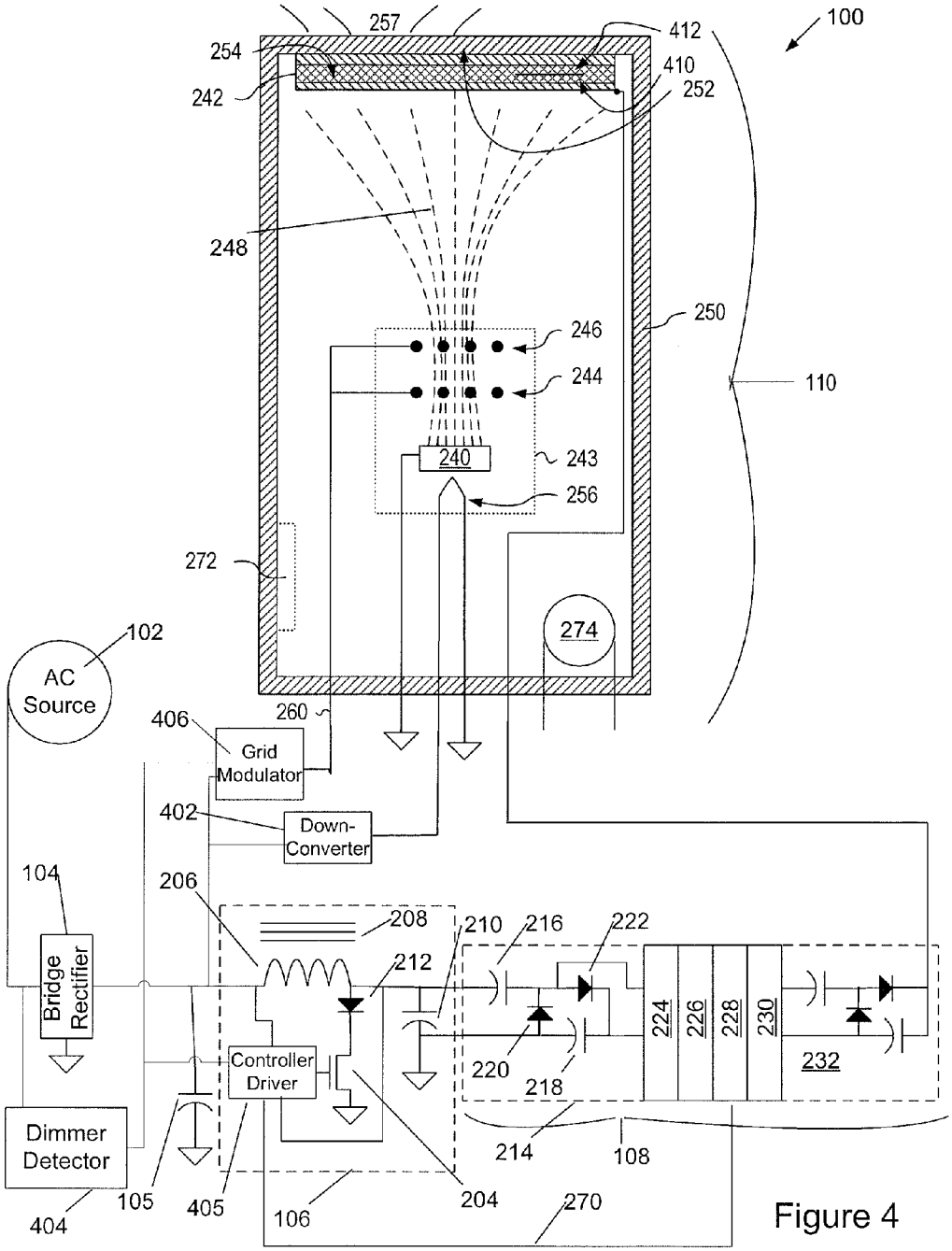
FIG. 4 is an approximate schematic diagram of a lighting system embodying a cathodoluminescent lighting device with thermionic cathode and a separate downconverter, and an inverter having an inductor with grounded cathode.

Another alternative embodiment of the cathodoluminescent lighting system 100, as illustrated in FIG. 4, has the cathode near ground and the anode positive and far from ground, with a total accelerating potential difference between anode and cathode of between two and thirty kilovolts, similar to that of the embodiment of FIG. 2. In this embodiment, operation of the bridge rectifier 104, and resonant inverter 106 are essentially equivalent to operation of the similar circuits of FIG. 2, save for inversion of feedback 270, and will not be separately described.

Figure 5:
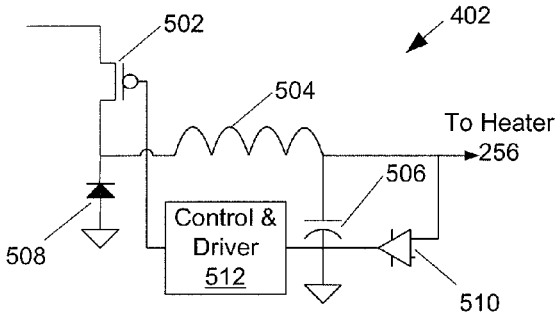
FIG. 5 illustrates a buck down-converter suitable for powering a cathode heater.

While some embodiments similar to that of FIG. 4 may use inductively coupled heater supply similar to that of FIG. 2, in the embodiment illustrated in FIG. 4 a separate buck-type down-converter 402, as illustrated in FIG. 5, or a down converter of another topology as are known in the switching supply art, may be used to tap power from capacitor 105 to power the heater 256, should cathodoluminescent tube 110 be of a hot-cathode type requiring heater 256. Buck-type down converter 402 (FIG. 5) has a switching transistor 502, that may be a P channel MOSFET as illustrated, a PNP bipolar transistor, or any other suitable switching transistor as known in the art. Switching transistor 502 applies brief pulses of power to an inductor 504, which in turn draws current from a filter capacitor 506 and heater 256. Between pulses, energy stored in inductor 504 causes continued current flow for a brief time from capacitor 506 and heater 256 through diode 508. Heater 256 voltage may be regulated by comparison by comparator 510 to a reference (not shown) and control circuitry 512. In some embodiments, down-converter 402 may also power the controller-driver 405 of the inverter 106. In alternative embodiments, current is regulated by control circuitry 512 instead of or in addition to voltage being regulated; in some of these embodiments current is regulated at a first level during a warm-up period, and at a second level during normal operation. In other alternative embodiments, an integrated circuit down-converter and regulator may be used.

Figure 6:
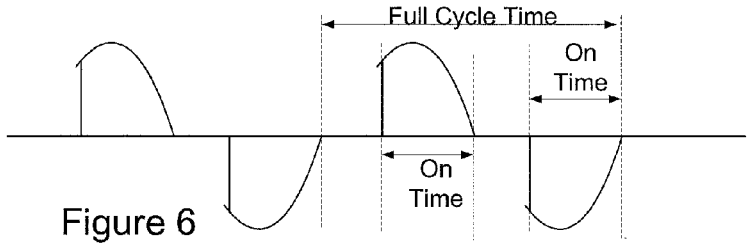
FIG. 6 illustrates waveforms provided by a triac inverter.

The embodiment of FIG. 4 is provided with a dimmer detector 404 that monitors a duty cycle of the incoming AC power source 102. As illustrated in FIG. 6, an output waveform of an external triac dimmer—such as is often installed in residential and commercial light-fixture wiring—provides power for only a portion or portions of each cycle. The dimmer detector 404 sums widths of "ON" times, dividing the sum by a total cycle time; it can therefore measure a duty cycle irrespective of whether the AC power source operates at 50 Hz as in Europe, or at 60 Hz as in the US, or at some other nearby frequency as may be provided by a generator. This measured duty cycle will typically be close to one hundred percent if no dimmer exists on AC supply 102, or is representative of a dimmer control setting if a triac dimmer exists on AC supply 102. Gate-turn-off (GTO) dimmers produce a waveform that is similar to a mirror image of the waveform illustrated in FIG. 6; the duty cycle from those dimmers can be detected and calculated with similar circuitry.

Figure 7B:
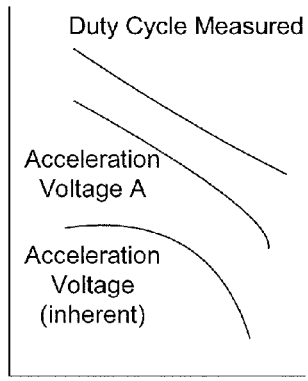
FIG. 7B illustrates dimming of the lighting system through acceleration voltage control.
Figure 7A:
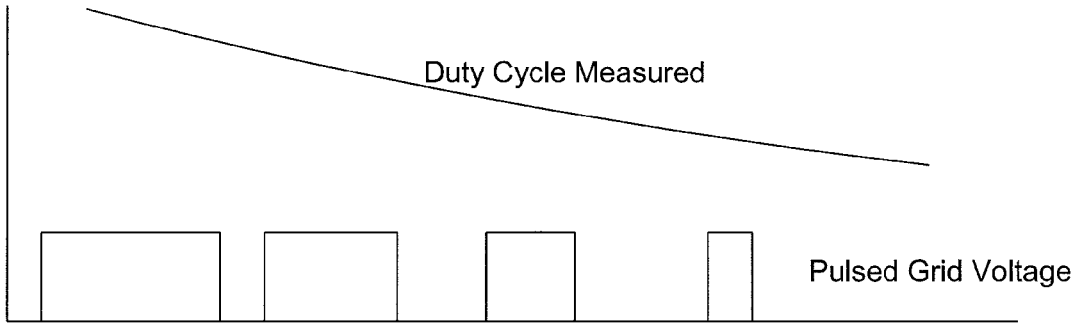
FIG. 7A illustrates dimming of the lighting system through grid pulsewidth control.
Figure 7:
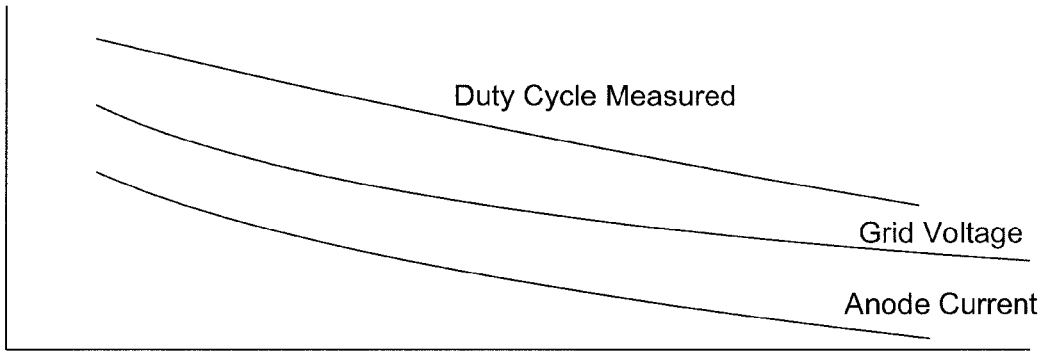
FIG. 7 illustrates dimming of the lighting system through grid voltage control.

In the embodiment of FIG. 4, and as illustrated in FIG. 7, a signal from the dimmer detector 404 indicative of the measured duty cycle of AC power source 102 is communicated to a grid modulator 406. Grid modulator 406 responds to this signal by adjusting voltage 260 applied to the extraction 244 and defocusing 246 grids of cathodoluminescent tube 110. It is expected that current between cathode 240 and anode 242 of cathodoluminescent tube 110 is dependent on voltage 260, and, since brightness of emitted light 257 in turn depends on both voltage and current, light output of the system 100 is therefore responsive to changes in settings of the triac dimmer. In a typical embodiment, full brightness is produced when the detected duty cycle exceeds a predetermined value that need not be one hundred percent to allow for turn-on delay of a triac. In an embodiment compatible with Silicon-Controlled Rectifier (SCR) dimmers that provide a pulsating DC signal lacking, for example, the negative half-cycles of FIG. 6 at a reduced rate of 50 or 60 pulses per second, the detected duty cycle may be calculated by dividing detected on time by half of the cycle time. An embodiment with large capacitor 105 may be compatible with Triac, GTO, and SCR dimmers and both 50 and 60 hertz power systems by dividing the detected on-time by half of the cycle time when pulse rate is less than 75 hertz, and by the cycle time when pulse rate is higher than 75 hertz. Functions like these, as well as pulse-width modulation of controller-inverter unit 106 or 156, are easy to implement on a microcontroller that may serve as a component of controller-driver 405.

In the embodiment of FIG. 4, the cathodoluminescent lighting system 100 responds to settings of the triac dimmer by reducing light output as duty cycle decreases.

In an alternative embodiment, the cathodoluminescent lighting system 100 operates inversely to resistive loads that may be coupled to the same triac dimmer by increasing light output as duty cycle decreases, until very low duty cycles are reached, when the inverter can not maintain adequate anode 242 to cathode 240 voltage potential difference. A lamp of this alternative, low-duty-cycle-increasing-output embodiment having a phosphor 254 optimized for a first color of emitted light 257 may be coupled in parallel with a lamp of the embodiment of FIG. 4 where low-duty-cycle decreases light 257 output and optimized for a second color of emitted light 257; the resulting system of two light-emitting devices responds to dimmer control settings by changing a color of overall emitted light 257 as one tube becomes dimmer and another tube becomes brighter.

In yet another embodiment resembling that of FIG. 4, or of FIG. 2 with the alternate grid bias supply and modulator of FIG. 2A, and as illustrated in FIG. 7A, the grid modulator 296 or 406 responds to the signal from dimmer detector 404 by altering a duty cycle of a pulse applied to the extraction 244 and defocusing 246 grids of cathodoluminescent tube 110; the pulse switching between a level at which current between the anode 242 and cathode 240 of the cathodoluminescent light emitting device 110 is essentially off, and a level at which this current is essentially on. This pulse causes the electron beam 248 to blink on and off with a duty cycle corresponding to average light output; because of the rapid pulse rate, the blinking electron beam 248 is integrated by a persistence of phosphor layer 254 and of the human eye, the light output 256 appears not to blink but to change in brightness in response to the dimmer setting.

In yet another embodiment, and as illustrated in FIG. 7B, the controller-driver 405 responds to the signal from dimmer detector 404 by altering an intended voltage for the anode 242 to cathode 240 acceleration voltage; controller-driver 405 causes the anode 242 to cathode 240 acceleration voltage to approximate this intended voltage by adjusting pulsewidth of switching device 204 of the controller-inverter 106. By doing so, the acceleration voltage may correspond to a setting of the external dimmer control in roughly linear manner, as illustrated as Acceleration Voltage A in FIG. 7B. In this embodiment, the acceleration voltage for full brightness will typically be between five and thirty kilovolts, while the acceleration voltage for a minimum brightness will be approximately two kilovolts.

Figure 7C:
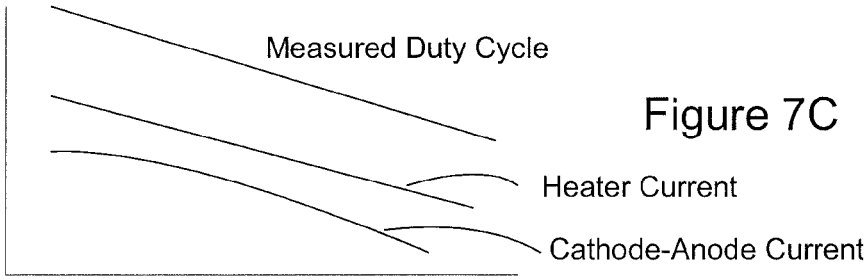
FIG. 7C illustrates dimming of the lighting system through heater current and heater temperature control.

In yet another embodiment, and as illustrated in FIG. 7C with reference to FIG. 4, the controller-driver 405 responds to the signal from dimmer detector 404 by adjusting a set point for heater 256 current of heater-supply down-converter 402. When dimmer detector 404 detects a full-on duty cycle, the heater 256 current is maintained at a high level, resulting in the cathode 240 being maintained at a high temperature such that high cathode 240-anode 242 current occurs, with bright light output. When dimmer detector 404 detects a reduced incoming duty cycle from an external triac dimmer, the dimmer detector 404 signal adjusts the heater 256 current maintained by down converter 42 to a lower level such that the cathode 240 is maintained at a lower temperature such that reduced anode 242-cathode 240 current occurs, with dimmer light output.

In yet another embodiment, which need not have a dimmer detector, controller-driver 405 maintains approximately constant pulsewidth of switching device 204 of controller-inverter 106. In this embodiment, assuming large capacitor 105, acceleration voltage will vary roughly proportionately with DC voltage at capacitor 105. While this voltage remains approximately constant while the input AC contains more than half of each half-cycle of mains AC, as the external dimmer cuts the input AC to less than half of each half-cycle, the voltage at capacitor 105 will drop with decreasing pulsewidth of the incoming AC, with result that acceleration voltage and brightness will dim along a curve such as represented by line Acceleration Voltage (Inherent) in FIG. 7B.

In yet another embodiment, cathode 240 heater 256 power supply down converter 402 responds to the signal from dimmer detector 404 by adjusting a set-point for cathode current, thereby altering temperature of the thermionic cathode 402 and altering cathode 240-anode 242 current in the cathodoluminescent tube 110.

The cathodoluminescent tube 110 of the embodiment of FIG. 4 resembles that of FIG. 2 and will not be separately described.

In yet another embodiment similar to that of FIG. 4, the phosphor layer 254 of the cathodoluminescent tube 110 is modified to be a bilayer, having a first layer 410 adjacent to anode 242 optimized for emitting a first color of light 256, and a second layer 412 adjacent to faceplate 252 optimized for emitting a second color of light 256. In this embodiment, a signal from dimmer detector 404 couples to inverter control-driver 405 such that the inverter 406 changes the anode 242 to cathode 240 potential difference. The change in potential difference is such that as the duty cycle of the controller-inverter increases, and anode 242 to cathode 240 voltage increases, electron beam 248 increases its percentage of penetration into the second phosphor 412 layer adjacent to faceplate 252, thereby changing the color of light 256 emitted from mostly the first to mostly the second color. In this embodiment, grid modulator 406 adjusts extraction grid 244 and defocusing grid 246 voltages to maintain cathode 240 to anode 242 current such that apparent brightness of emitted light 256 is unaffected unless the duty cycle decreases below a minimum required for proper operation.

Figure 8:
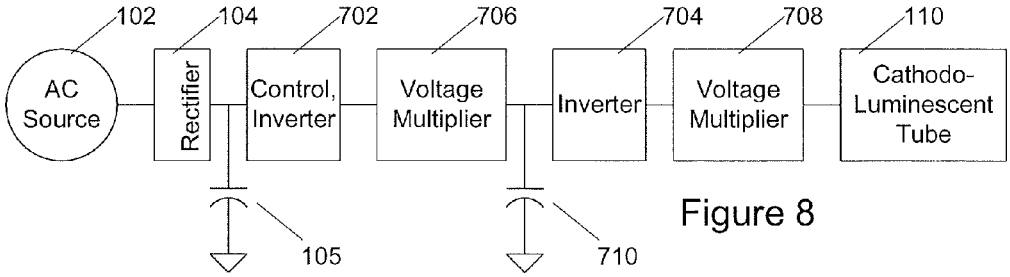
FIG. 8 is a block diagram of an alternative embodiment having two inverter stages.
Figure 9:
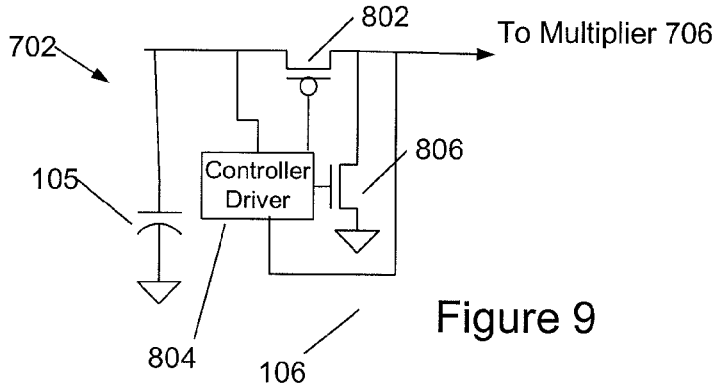
FIG. 9 is an approximate schematic diagram of an inductorless inverter suitable for use with the embodiment of FIG. 8.

In an alternative embodiment, as illustrated in FIG. 8, controller-inverter unit 106 is replaced by two stages of inverter-control 702 and inverter 704, and voltage multiplier-rectifier chain 108 with a first 706 and a second 708 voltage multiplier-rectifier chain. A second filter capacitor 710 is present at the output of the first voltage multiplier 706. This embodiment permits use of fewer voltage multiplier stages than may be otherwise required, especially if no inductor is provided in inverters 702 and 704. While functional with inverters having inductors such as inductor 206, the embodiment of FIG. 8 is particularly suited for use with inductorless inverters such as that illustrated in FIG. 9.

Inductorless inverters such as that illustrated in FIG. 8 are particularly suitable for implementation as integrated circuits. In this embodiment, a first transistor 802 is turned on by controller/driver 804 to admit power from filter capacitor 105 to create a rising edge of a square-wave AC voltage that goes to the first 706 voltage multiplier-rectifier chain. This first transistor 802 then shuts off and a second transistor 806 drives the input to the first 706 voltage multiplier-rectifier chain low, providing a falling edge of the square-wave AC voltage. In this embodiment, first 706 voltage multiplier-rectifier chain steps up the voltage from about one hundred sixty volts at capacitor 105 to about one kilovolt at second filter capacitor 710. The second stage inverter 704 drives second multiplier-rectifier stage 708 to produce a two kilovolt to thirty kilovolt anode to cathode potential.

Figure 10:
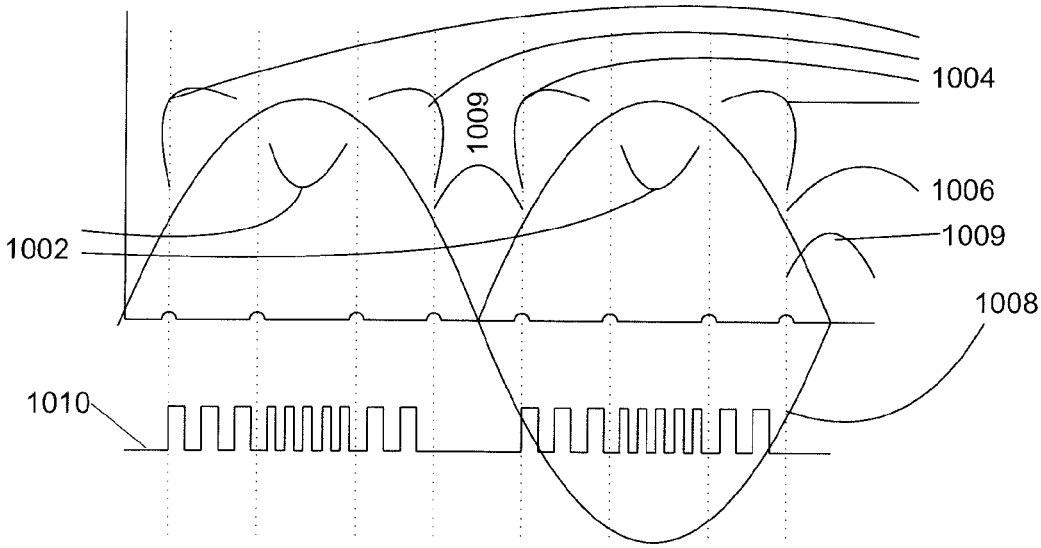
FIG. 10 illustrates power factor compensation with a pulse-width-modulated inverter having an inductor.

With large capacitance at filter capacitor 105 (FIG. 2), current draw by the cathodoluminescent lighting system occurs mostly near peaks of incoming sine-wave AC power source 102, the peak region 1002 in FIG. 10, with little or no power drawn at other points in the cycle of the incoming sine-wave AC power. This can produce a poor "power factor", such that large numbers of high power lighting systems of this type can cause inefficient operation of the power source as well as causing excessive radio frequency interference.

In order to compensate for this, in a power-factor corrected embodiment having an inductor-equipped controller-inverter unit 106, as shown in FIG. 2, and used particularly either without dimming or with gate pulsing dimming, filter capacitor 105 is made small—just big enough to minimize radiation due to switching of transistor 204, such that considerable ripple may be observed across filter capacitor 105.

In this enhanced power-factor embodiment, during shoulder regions 1004 of the bridge rectified pulsating DC 1006, the controller-inverter unit 106 operates with an increased switching-transistor 204 pulsewidth such that the voltage at output of inductor 206 continues to kick up high enough to provide a high-enough AC output voltage at the input of voltage multiplying rectifier 108 to ensure that appropriate power is drawn from the AC power source 102 and fed to the voltage multiplier 108. In this embodiment, instantaneous phase, or whether the incoming AC power is at peak 1002, shoulder 1004, or near crossover 1009 of the incoming sine wave 1008, is detected by instantaneous phase and dimmer detector 174 (FIG. 1A) by measuring voltage across capacitor 105 and comparing the voltage measured with a peak voltage measured during a previous cycle or half cycle.

A single embedded microcontroller is capable of determining both instantaneous phase and duty cycle provided by an external dimmer, as well as whether the incoming AC voltage is fifty or sixty cycle, one hundred fifteen or two hundred thirty volt, power and determining an appropriate instantaneous pulse width and pulse rate for the inverter. In a microcontroller embodiment, instantaneous phase and dimmer detector 174, the controller portion of controller-driver 405 of controller-inverter 406, and controller portions of grid modulator 406 and heater power supply down converter 402 may all be implemented within a single microcontroller.

In this enhanced power-factor embodiment, the controller-inverter unit 106 operates with a reduced pulse rate in shoulder regions 1004 to reduce the total power drawn in the shoulder regions 1004 so as to approximate a sinusoidal power draw from AC supply 102. Similarly, the controller-inverter unit 106 pulse rate may stop momentarily during zero-crossing regions 1009 of the incoming waveform. Waveform 1010 illustrates some of the pulsewidth and pulse rate changes, albeit illustrated at a much reduced rate, that occurs through a cycle of the incoming AC power. These changes in pulse width and rate throughout a cycle may be readily controlled by a microcontroller in the controller-driver 202, 405 of controller-inverter unit 106, 156.

In this enhanced power-factor embodiment, feedback 270 control of controller-inverter unit 106, and charge storage in capacitors 218 may be sufficient that anode 242 to cathode 240 voltage may remain essentially constant throughout each cycle.

In an alternative embodiment, a three-contact connector, such as a 3-way Edison base, having two AC inputs and a neutral input, is used. In this embodiment, two bridge rectifiers are incorporated into bridge rectifier and noise filter unit 104, such that the lighting system 100 is capable of operation off of either of the two AC inputs. Dimmer detector 174, 404 operates by determining which of the two AC inputs, or both, are active, and providing an appropriate output signal to grid power and control 162, 406. This alternative device is compatible with lighting fixtures of the "3-way" type, such that both AC inputs being "on" gives a first level of light output, a first of the AC inputs being "on" with a second "off" gives a second level of light output, and the second of the AC inputs being "on" with the first "off" gives a third level of light output.

While the forgoing has been particularly shown and described with reference to particular embodiments thereof, it will be understood by those skilled in the art that various other changes in the form and details may be made without departing from the spirit hereof. It is to be understood that various changes may be made in adapting the description to different embodiments without departing from the broader concepts disclosed herein and comprehended by the claims that follow.

What is claimed is:

1. A method of providing light, comprising:

rectifying an AC power source to provide DC power;

applying pulses of the DC power to an inductor, the inductor providing high voltage pulses;

adjusting the high voltage pulses according to a duty cycle of the AC power source;

rectifying the high voltage pulses with voltage multiplying and rectifying apparatus to provide high voltage DC power;

applying the high voltage DC power between an anode and a cathode of a cathodoluminescent device to provide light;

wherein the pulses of the DC power are adapted in at least one of pulse width and pulse rate to optimize a power factor; the adaptation for optimizing power factor including providing the pulses of the DC power applied to the inductor with a wider pulsewidth during shoulder regions of a sinusoidal waveform of the AC power source than during peak regions of the sinusoidal waveform of the AC power source.

2. The method of claim 1, further comprising applying voltages to an extraction grid and a defocusing grid of the cathodoluminescent device.

3. A method of providing light, comprising:

rectifying an AC power source to provide DC power;

applying pulses of the DC power to an inductor, the inductor providing high voltage pulses;

rectifying the high voltage pulses with voltage multiplying and rectifying apparatus to provide high voltage DC power;

applying the high voltage DC power between an anode and a cathode of a cathodoluminescent device to provide light; and varying signals to an extraction grid and a defocusing grid of the cathodoluminescent device according to a duty cycle of the AC power source.

4. The method of claim 3, wherein the pulses of the DC power are adapted in at least one of pulse width and pulse rate to optimize a power factor.

5. The method of claim 4, wherein the pulses of the DC power applied to the inductor are provided with a wider pulsewidth during shoulder regions of a sinusoidal waveform of the AC power source than during peak regions of the sinusoidal waveform of the AC power source to optimize the power factor.

6. The method of claim 3, the step of varying signals to the extraction grid and the defocusing grid of the cathodoluminescent device comprising adjusting voltages to the extraction grid and the defocusing grid.

7. The method of claim 3, the step of varying signals to the extraction grid and the defocusing grid of the cathodoluminescent device comprising adjusting duty cycle of pulses applied to the extraction grid and the defocusing grid.

8. A method of providing light, comprising:

rectifying an AC power source to provide DC power;

applying pulses of the DC power to an inductor, the inductor providing high voltage pulses;

rectifying the high voltage pulses with voltage multiplying and rectifying apparatus to provide high voltage DC power;

applying the high voltage DC power between an anode and a thermionic cathode of a cathodoluminescent device to provide light; and varying heat to the thermionic cathode according to a duty cycle of the AC power source.

9. The method of claim 8, the step of varying heat comprising adjusting a set point of a heater adapted to heat the thermionic cathode.

10. The method of claim 8, the step of varying heat comprising adjusting current to a heater adapted to heat the thermionic cathode.

11. The method of claim 8, wherein the pulses of the DC power are adapted in at least one of pulse width and pulse rate to optimize a power factor.

12. The method of claim 11, wherein the pulses of the DC power applied to the inductor are provided with a wider pulsewidth during shoulder regions of a sinusoidal waveform of the AC power source than during peak regions of the sinusoidal waveform of the AC power source to optimize the power factor.

* * * * *